US012163520B2

(12) United States Patent
Peters et al.

(10) Patent No.: US 12,163,520 B2
(45) Date of Patent: Dec. 10, 2024

(54) ROTARY PUMP COMPRISING A SETTING STRUCTURE SPRING HAVING AN OFFSET LINE OF ACTION

(71) Applicant: Schwäbische Hüttenwerke Automotive GmbH, Aalen (DE)

(72) Inventors: Sven Peters, Bad Schussenried (DE); Igor Pekrul, Aulendorf (DE); Thomas Wahl, Ertingen (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 17/875,941

(22) Filed: Jul. 28, 2022

(65) Prior Publication Data

US 2023/0032977 A1 Feb. 2, 2023

(30) Foreign Application Priority Data

Jul. 30, 2021 (DE) ..... 10 2021 119 936.0

(51) Int. Cl.
*F04C 2/344* (2006.01)
*F04C 14/22* (2006.01)
*F04C 15/00* (2006.01)

(52) U.S. Cl.
CPC ..... *F04C 2/3442* (2013.01); *F04C 14/223* (2013.01); *F04C 15/0042* (2013.01)

(58) Field of Classification Search
CPC ... F04C 2/3442; F04C 14/223; F04C 15/0042
See application file for complete search history.

(56) References Cited

U.S. PATENT DOCUMENTS 2,985,109 A * 5/1961 Ernst ..... F04C 14/223 417/220
3,070,020 A * 12/1962 Pierce ..... F04C 14/223 417/220

(Continued)

FOREIGN PATENT DOCUMENTS

DE 102014212309 A1 12/2015
DE 102019112278 A1 1/2020
WO 2008003169 A1 1/2008

OTHER PUBLICATIONS

German Search Report issued in Patent Application No. DE 10 2021 119 936.0, mailed Apr. 21, 2022, 7 pages, partial translation.

*Primary Examiner* — Mary A Davis
(74) *Attorney, Agent, or Firm* — Buchanan Ingersoll & Rooney PC

(57) ABSTRACT

A rotary pump including: a pump housing including a delivery chamber, having an inlet and an outlet for a fluid; a delivery member which can be rotated about a rotational axis in the delivery chamber in order to deliver the fluid; a setting structure which can be moved translationally back and forth in the pump housing relative to the delivery member in and counter to a setting direction in order to adjust the delivery volume of the rotary pump; a setting device for generating a setting force which acts on the setting structure in the setting direction; a restoring spring for exerting a restoring force which acts on the setting structure counter to the setting direction; and an additional spring for exerting an additional force which acts on the setting structure in or counter to the setting direction.

21 Claims, 7 Drawing Sheets

(56) References Cited

U.S. PATENT DOCUMENTS

| | | | | |
|---|---|---|---|---|
| 3,396,666 | A * | 8/1968 | Moochhala | F04C 14/223 418/82 |
| 3,813,189 | A * | 5/1974 | Tompkins | F01C 20/22 417/220 |
| 8,545,199 | B2 * | 10/2013 | Koller | F04C 14/223 418/24 |
| 9,651,046 | B2 * | 5/2017 | Williamson | F04C 2/3442 |
| 10,648,468 | B2 * | 5/2020 | Gulde | F04C 14/223 |
| 2013/0309113 | A1 | 11/2013 | Rago | |
| 2017/0306948 | A1 | 10/2017 | De Andrade Filho et al. | |
| 2020/0032791 | A1 | 1/2020 | Bennett, Sr. et al. | |

* cited by examiner

ROTARY PUMP COMPRISING A SETTING STRUCTURE SPRING HAVING AN OFFSET LINE OF ACTION

CROSS REFERENCE TO RELATED APPLICATIONS

This application claims benefit of priority of German Patent Application No. 10 2021 119 936.0, filed Jul. 30, 2021. The contents of this application are incorporated herein by reference.

FIELD OF THE INVENTION

The invention relates to a rotary pump having an adjustable delivery volume, preferably a vane pump, for supplying a machine assembly with fluid. The fluid is preferably oil for a machine assembly, for example for a gearbox or engine of a motor vehicle. The rotary pump includes a pump housing comprising a delivery chamber, wherein the delivery chamber has a low-pressure region and a high-pressure region. The low-pressure region of the delivery chamber has a delivery chamber inlet for the fluid to be delivered, and the high-pressure region of the delivery chamber has a delivery chamber outlet for the fluid. The rotary pump also includes a delivery member which can be rotated about a rotational axis in the delivery chamber in order to deliver the fluid, and which when rotated enables the fluid to be suctioned through the delivery chamber inlet into the delivery chamber and expelled through the delivery chamber outlet.

The rotary pump is preferably a crankshaft pump, i.e. the rotary pump is preferably seated directly on the crankshaft of the machine assembly, for example on the crankshaft of a motor vehicle engine. The rotational speed of the crankshaft pump is thus the same as the rotational speed of the crankshaft. Since the volume flow of the fluid to be delivered is dependent on the rotational speed of the pump and can exceed the actual fluid requirement, rotary pumps having an adjustable delivery volume have been developed in which the delivery volume can be adjusted as required. Such pumps are well known to those skilled in the art, for which reason their structure shall only be superficially discussed here.

BACKGROUND OF THE INVENTION

Rotary pumps having an adjustable delivery volume usually include a setting structure, a setting device for generating a setting force which acts on the setting structure, and a restoring device for generating a restoring force which acts on the setting structure. In rotary pumps in particular, internal forces are generated in the delivery chamber while the pump is in operation which can act on the setting structure and can negatively influence the regulating characteristics of the pump.

These internal forces can for example be generated by the fluid pressure prevailing in the delivery chamber and/or by frictional forces of the delivery member. The internal forces can then for example cause an unintentional change in the contact area of the setting structure, i.e. unintentionally increase or decrease the delivery volume, and/or generate a torque which acts on the setting structure and can cause a change in the contact area of the setting structure and/or negatively affect the service life of the setting structure.

In particular, the torque which acts on the setting structure can subject the sliding surfaces and/or abutments of the setting structure to additional load, due to an increased pressing force, and thus promote wear. It can also transpire that the torque which acts on the setting structure reduces the contact pressing force which acts on the sliding surfaces which rest against each other in a seal between the setting structure and the pump housing. This can cause the sliding surfaces to be pressed away from each other, thus reducing the sealing action of the sliding surfaces.

In vane pumps in particular, friction between the vane tips and the setting structure which encloses the delivery chamber radially on the outside generates a frictional moment which can for example negatively affect the regulating characteristics of the pump and/or promote wear on the setting structure and/or the pump in general. The frictional moment generated is a torque which acts on the setting structure in the rotational direction of the delivery member. Such internal torques can for example cause the sliding surfaces of a translationally movable setting structure to be subjected to high loads, thus increasing wear.

In vane pumps comprising a translationally adjustable setting structure in particular, the frictional moment increases the contact pressing force on some sliding surfaces, while reducing it on the other sliding surfaces. This can cause increased wear and/or a reduced sealing action in the corresponding sliding surfaces, depending on whether the contact pressing force is increased or reduced.

Due among other things to the high rotational speed of the crankshaft, crankshaft pumps in the automotive sector can also reach very high fluid pressures which can generate large internal forces and subject the pump to additional load. In vane pumps in particular, high rotational speeds also generate high frictional moments at the vane tips, since the vanes are subject to high centrifugal force due to the high rotational speeds.

SUMMARY OF THE INVENTION

Therefore, an aspect of the invention is a rotary pump which is less sensitive to internal forces and/or moments.

An aspect of the invention relates to a rotary pump having an adjustable delivery volume, in particular a vane pump, pendulum-slider pump or gear pump. The rotary pump is preferably embodied as a crankshaft pump and is preferably driven directly by the crankshaft of a machine assembly, i.e. a delivery member of the rotary pump is connected directly to the crankshaft and/or seated directly on the crankshaft. If the rotary pump is a crankshaft pump, the rotational speed of the delivery member corresponds to the rotational speed of the crankshaft. In a crankshaft pump, the delivery member and the crankshaft have a transmission ratio of 1.

The rotary pump is preferably a crankshaft pump of an automobile for delivering oil. In alternative embodiments, the rotary pump can also be embodied as a pump comprising a gear drive, toothed belt drive or chain drive.

The rotary pump includes a pump housing comprising a delivery chamber, the low-pressure region of which has a delivery chamber inlet for the fluid to be delivered, and the high-pressure region of which has a delivery chamber outlet for the fluid. The pump housing is preferably formed in multiple parts and includes at least a housing cup and a housing cover.

The delivery chamber inlet and/or the delivery chamber outlet is/are preferably formed as a suction pocket and/or a pressure pocket. The delivery chamber inlet and/or the delivery chamber outlet is/are preferably formed in the pump housing, in particular in the housing cup. Alternatively, or additionally, the delivery chamber inlet and/or the delivery chamber outlet can be formed in the radially exterior delineation of the delivery chamber, for example as a breach and/or cavity, for example in a setting structure. The fluid to be delivered is preferably oil for a machine assembly, in particular a gearbox or engine of an automobile.

The delivery chamber of the rotary pump has a delivery member, which can be rotated about a rotational axis, for delivering the fluid. In preferred embodiments, the rotary pump is a vane pump, wherein the delivery member has a delivery rotor and at least one vane which is mounted, such that it can slide, in the delivery rotor. In alternative embodiments, the pump is a pendulum-slider pump or a gear pump, in particular an internal gear pump. If the rotary pump is a crankshaft pump, then the delivery rotor is preferably seated on the crankshaft.

In order to adjust the delivery volume, the pump housing of the rotary pump includes a setting structure which can be moved back and forth relative to the delivery member in and counter to a setting direction and which has an inner contour which delineates the delivery chamber radially on the outside. The inner contour of the setting structure is preferably embodied to be circular. In alternative embodiments, the inner contour can for example also be embodied to be oval, in particular elliptical. The center point of the inner contour of the setting structure and the rotational axis of the delivery member are preferably offset eccentrically with respect to each other, wherein the eccentricity is preferably decreased when the delivery volume is decreased.

The setting structure can be formed by a setting ring which encloses the delivery chamber radially on the outside. The axially end-facing side of the delivery chamber is preferably delineated by the pump housing.

Preferably, the setting structure can be translationally moved back and forth in the pump housing in and counter to the setting direction, in particular while being linearly guided. In alternative embodiments, the setting structure can also be pivotable in and counter to the setting direction in the pump housing. Moving the setting structure in the setting direction preferably throttles the pump, i.e. reduces the delivery volume. Accordingly, moving the setting structure counter to the setting direction preferably increases the delivery volume.

For adjusting the setting structure in the setting direction, the rotary pump includes a setting device for generating a setting force which acts on the setting structure in the setting direction. The setting force preferably acts in the direction of a minimum delivery volume.

The setting force can act permanently on the setting structure or can be generated in order to adjust the delivery volume, wherein the setting force can have a constant or variable magnitude. The setting force can also be composed of multiple force components, wherein for example one force component can act permanently on the setting structure and another force component can for example be introduced. If the setting force is composed of multiple force components, then one force component can for example be constant and another force component can for example have a variable magnitude.

The setting force can for example be generated by a fluid, in particular high-pressure fluid, which acts on a setting surface of the setting structure. The rotary pump and in particular the setting device can include one or more fluid setting chambers which are permanently or selectively connected to the high-pressure region of the delivery chamber in order to permanently or selectively apply a fluid pressure to the setting surface of the setting structure in the setting direction. Preferably, high-pressure fluid from the high-pressure side of the pump is applied to the setting surface of the setting structure, in particular permanently. The pressure fluid can be diverted from the delivery chamber outlet and fed to the setting surface of the setting structure directly or for example via a control valve.

In addition, or as an alternative to applying high-pressure fluid to a setting surface, a setting spring can for example act on the setting surface in the setting direction. Alternatively, the setting force can also for example be generated by an externally regulated setting device. The person skilled in the art is well aware of setting devices for adjusting the delivery volume of pumps and in particular the mechanisms for generating a setting movement, for which reason the latter will not be discussed further here.

In addition to the setting device, the rotary pump can include a restoring spring for exerting a restoring force which acts on the setting structure counter to the setting direction. The restoring force preferably acts counter to the setting force. The restoring force preferably acts in the direction of a maximum delivery volume.

The restoring force can cross the rotational axis R of the delivery member at a distance $d_R$ or can act radially on the setting structure in relation to the inner contour. In preferred embodiments, the restoring spring acts radially on the setting structure in relation to the inner contour in the direction of the rotational axis of the delivery member.

If the restoring force crosses the rotational axis of the delivery member at a distance $d_R$, then the distance $d_R$ is preferably at most 40%, in particular at most 30%, of an inner width of the inner contour as measured radially with respect to the rotational axis. The inner width is preferably measured orthogonally with respect to the setting direction. The inner width of the inner contour is preferably understood to mean the greatest extent of the inner contour transverse to the setting direction. If the inner contour is circular, the inner width corresponds to the diameter of the inner contour, i.e. if the inner contour is circular, the distance $d_R$ of the restoring force is at most 40%, preferably at most 30%, of the diameter of the inner contour.

The restoring spring is preferably formed by a helical compression spring. In alternative embodiments, the restoring spring can also be formed by a leaf spring, disc spring, hollow rubber spring or the like. If the restoring spring is a helical compression spring, it can be a cylindrical or non-cylindrical helical compression spring, such as for example a volute spring, barrel spring or tapered spring.

The restoring spring is preferably arranged in a restoring space. The restoring space is preferably arranged in the pump housing and can be fluidically connected to the low-pressure region of the delivery chamber. The restoring space is preferably arranged on the setting structure, radially opposite a fluid setting chamber of the setting device, in the pump housing. The restoring space is preferably arranged radially opposite a fluid setting chamber of the setting device in the setting direction in the pump housing.

The rotary pump can also include an additional spring for exerting an additional force which acts on the setting structure in or counter to the setting direction. The additional force can act on the setting structure counter to the setting force or in the direction of the setting force. The restoring force and the additional force can act on the setting structure parallel to each other. The additional force preferably acts counter to the setting direction.

The additional force can act permanently on the setting structure or can be introduced in addition to the restoring force or setting force. The additional force is preferably generated by the additional spring which acts permanently on the setting structure. The additional spring is preferably formed by a helical compression spring which acts permanently on the setting structure.

The additional force preferably crosses the rotational axis R of the delivery member at a lever arm distance d. The lever arm distance d of the additional force is preferably at most 40%, in particular at most 30%, of an inner width of the inner contour as measured radially with respect to the rotational axis. The inner width is preferably measured orthogonally with respect to the setting direction, i.e. the inner width of the inner contour is preferably orientated orthogonally with respect to the setting direction; in particular, the inner width and the setting direction extend at right angles to each other.

The inner width of the inner contour is preferably understood to mean the greatest extent of the inner contour transverse to the setting direction. If the inner contour is circular, the inner width corresponds to the diameter of the inner contour, i.e. if the inner contour is circular, the lever arm distance d of the additional force is at most 40%, preferably at most 30%, of the diameter of the inner contour.

The additional spring is preferably formed by a helical compression spring. In alternative embodiments, the additional spring can also be formed by a leaf spring, disc spring, hollow rubber spring or the like. If the additional spring is a helical compression spring, it can be a cylindrical or non-cylindrical helical compression spring, such as for example a volute spring, barrel spring or tapered spring.

The additional spring and the restoring spring can be identically formed, i.e. the restoring spring and the additional spring can for example both be formed by a helical compression spring. In alternative embodiments, the restoring spring and the additional spring can be formed differently. For example, the restoring spring can be formed by a helical spring and the additional spring by a leaf spring.

The additional spring can be arranged in the restoring space of the restoring spring or in an additional space. The additional space can for example be formed by a fluid setting chamber of the setting device. If the additional spring is arranged in an additional space, then the additional space is preferably fluidically separated from the restoring space. The additional spring is preferably arranged orthogonally with respect to the setting direction, alongside the restoring spring in the restoring space.

Wherever, in the course of this application, mention is made of a force, in particular a restoring force and/or additional force, which acts in or counter to the setting direction, this may be understood to mean that at least a force component, in particular the largest force component, of the force acts in or counter to the setting direction. The overall force of the restoring spring and/or additional spring preferably acts in or counter to the setting direction.

The largest force component of the restoring force and/or additional force can act on the setting structure parallel to the setting direction or at an acute angle of less than 10° to the setting direction. The restoring force of the restoring spring and/or the additional force of the additional spring particularly preferably act(s) on the setting structure parallel to the setting direction or at an acute angle of less than 10° to the setting direction only, i.e. the restoring spring and/or the additional spring preferably (each) generate(s) a resultant overall force which acts on the setting structure parallel to the setting direction or at an acute angle of less than 10° to the setting direction only.

The restoring force and the additional force can act on the setting structure at an acute angle to each other. In particular, the restoring force and the additional force can act on the setting structure at an angle of less than or equal to 20°, preferably less than or equal to 10,° to each other, i.e. the line of action of the restoring force and the line of action of the additional force together enclose an angle which is less than or equal to 20°, in particular less than or equal to 10°.

The restoring force and the additional force preferably act on the setting structure substantially parallel to each other. This means the restoring force and the additional force act on the setting structure at an angle of less than or equal to 5° to each other. The restoring force and the additional force preferably act on the setting structure parallel to each other. This means that the line of action of the additional force and the line of action of the restoring force preferably extend in parallel and do not intersect.

The restoring force and/or the additional force can act on the setting structure secantially with respect to the inner contour. Within the meaning of the application, "secantially" means that the line of action of the additional force and/or restoring force intersects the curve of the inner contour at two points, in particular within a plane which is parallel to the end-facing surface of the setting structure, wherein the line of action does not pass through a center point and/or center axis of the inner contour. Within the meaning of the application, "secantially" therefore means that the line of action of the additional force and/or restoring force forms a secant of the inner contour.

The inner contour of the setting structure has an inner width orthogonally with respect to the setting direction, wherein the inner width is preferably measured radially with respect to the rotational axis. The additional force can act on the setting structure from a bisector B, which sub-divides the inner width into two portions of equal length, at a lever arm distance d measured transversely with respect to the setting direction. The restoring force can additionally also act on the setting structure from the bisector B at a distance $d_R$ measured transversely with respect to the setting direction.

The bisector B can divide the delivery chamber into a high-pressure region and a low-pressure region of the delivery chamber. The line of action of the restoring force preferably overlaps with the bisector B in an axial plan view onto the setting structure, such that the distance $d_R$ transverse to the setting direction is equal to zero. If the line of action of the restoring force does not overlap with the bisector in an axial plan view onto the setting structure, then the restoring force and the additional force preferably act transversely with respect to the setting direction on the same side of the bisector B. Alternatively, the additional force and the restoring force can act on different sides of the bisector B transversely with respect to the setting direction.

The restoring force can act on the setting structure radially with respect to the rotational axis and/or inner contour or can cross the rotational axis at a distance $d_R$ which is less than the lever arm distance d at which the additional force crosses the rotational axis. Preferably, at least one of the additional force and the restoring force acts on the setting structure secantially with respect to the inner contour. Preferably, the restoring force acts on the setting structure radially with respect to the rotational axis, and the additional force acts on the setting structure secantially with respect to the inner contour.

Within the meaning of the application, "radially with respect to the inner contour" means that the line of action of the additional force and/or restoring force extends through the center point and/or center axis of the inner contour, i.e. if the inner contour is circular and/or circular-cylindrical, the line of action of the additional force and/or restoring force overlaps with the diameter of the inner contour. Within the meaning of the application, "radially with respect to the rotational axis" means that the line of action of the additional force and/or restoring force extends through the rotational axis of the delivery member. If the eccentricity between the center axis of the inner contour and the rotational axis is zero, i.e. the center axis of the inner contour and the rotational axis overlap with each other, then "radially with respect to the rotational axis" simultaneously also means "radially with respect to the inner contour".

The additional force preferably acts counter to the setting direction on a portion of the setting structure surrounding the high-pressure region of the delivery chamber, or alternatively acts in the setting direction on a portion of the setting structure surrounding the low-pressure region of the delivery chamber.

The restoring force can act counter to the setting direction on a portion of the setting structure surrounding the high-pressure region of the delivery chamber or counter to the setting direction on a portion of the setting structure surrounding the low-pressure region of the delivery chamber. Alternatively, the restoring force can also act counter to the setting direction on the portion of the setting structure surrounding the transition between the high-pressure region and the low-pressure region of the delivery chamber.

The restoring force can act radially or secantially on the setting structure. The restoring force and the additional force can be the only external force acting on the setting structure which acts counter to the setting force. In particular when the rotary pump does not include an additional spring, the restoring force is preferably the only external force acting on the setting structure which acts counter to the setting force.

The additional force preferably generates a torque which acts on the setting structure. The torque is preferably directed oppositely to the rotary direction of the delivery member, in particular when the pump is operating normally, i.e. the additional force preferably generates a torque which is directed anti-clockwise when the delivery member is rotating clockwise when the pump is operating normally, wherein "the pump is operating normally" is understood to mean that the pump is operating as provided for by the drive means of the pump and in particular that the delivery member is rotating in the rotational direction provided for by the drive means of the pump. It is substantially understood to mean that the pump is operating without disruption.

The torque generated by the additional force preferably compensates for the torque which is generated by the friction of the delivery member and which likewise acts completely or partially on the setting structure. This has the advantage that the additional force can increase or reduce the contact pressing force which can act on the individual sliding surfaces of the setting structure and may be reduced or increased by the frictional moment of the delivery member, i.e. the additional force preferably reduces or compensates for the effect which the friction of the delivery member has on the setting structure.

The additional force thus preferably prevents the sliding surfaces which rest against each other in a seal between the setting structure and the pump housing from being pressed away from each other due to a reduction in the contact pressing force caused by the frictional moment, thus reducing the sealing action of the sliding surfaces, or from rubbing against each other more strongly due to an increase in the contact pressing force caused by the frictional moment, and thus wearing down more significantly.

The additional force can additionally compensate at least partially for a torque which is generated by the setting force and/or the restoring force and which acts on the setting structure.

Since the torque generated by the friction of the delivery member depends inter alia on the rotational speed of the delivery member, the torque generated by the additional force is at least as large as the smallest torque generated by the delivery member when the pump is in operation.

Alternatively, or additionally, the restoring force can also generate a torque which acts on the setting structure. The torque of the restoring force can be directed oppositely to the rotary direction of the delivery member or can act in the rotary direction of the delivery member, in particular when the pump is operating normally. The torque generated by the restoring force can completely or partially compensate for the torque which is generated by the friction of the delivery member and which likewise acts on the setting structure. Alternatively, the torque generated by the restoring force can amplify the torque which is generated by the friction of the delivery member and which likewise acts on the setting structure.

In particular when the rotary pump does not include an additional spring and the restoring force is the only external force acting on the setting structure counter to the setting direction, the torque generated by the restoring force can completely or partially compensate for the torque which is generated by the friction of the delivery member and which likewise acts on the setting structure.

Since the torque generated by the friction of the delivery member depends inter alia on the rotational speed of the delivery member, the torque generated by the restoring force is at least as large as the smallest torque generated by the delivery member when the pump is in operation, when the rotary pump does not include an additional spring.

The restoring force and the additional force are preferably introduced into the setting structure at a spring force distance D from each other which is orthogonal with respect to the setting direction. The spring force distance D can be equal to or greater than the lever arm distance d at which the additional force crosses the rotational axis of the delivery member, such that $D \geq d$. The restoring force can act on the setting structure radially with respect to the rotational axis, such that the spring force distance D corresponds to the lever arm distance d at which the additional force crosses the rotational axis, i.e. $D=d$. In alternative embodiments, the spring force distance D can be less than the lever arm distance d ($D<d$) or greater than the lever arm distance d ($D>d$).

The restoring force and the additional force can differ in magnitude. The restoring force is preferably greater than the additional force and particularly preferably at least twice as large as the additional force. The restoring force is preferably greater than the additional force in one or more positions which the setting structure can assume within the scope of its mobility in and counter to the setting direction. The restoring force is preferably greater than the additional force in any position of the setting structure.

The restoring force and the additional force preferably differ in magnitude in one or more different positions which the setting structure can assume within the scope of its mobility in and counter to the setting direction. Preferably, the restoring force and the additional force differ in magnitude in any position of the setting structure.

The magnitude of the additional force is preferably selected in accordance with the lever arm distance d. The greater the lever arm distance d, the smaller the additional force and vice versa. Conversely, the additional force can be greater if the lever arm distance d is small.

The restoring spring can have a first spring constant, and the additional spring can have a second spring constant. The first spring constant of the restoring spring and the second spring constant of the additional spring can differ in magnitude. The first spring constant of the restoring spring can for example be greater than the second spring constant of the additional spring, i.e. the restoring spring can be harder than the additional spring. Alternatively, the second spring constant of the additional spring can be greater than the first spring constant of the restoring spring.

The first spring constant of the restoring spring and the second spring constant of the additional spring can be selected in accordance with the spring force distance D. The second spring constant of the restoring spring is preferably selected in consideration of the lever arm distance d.

The second spring constant of the additional spring should preferably be large enough to generate an additional force $F_A$ which is large enough to compensate for the torque caused by the friction of the delivery member. The second spring constant of the additional spring is preferably configured in accordance with the lever arm distance d. If the lever arm distance d is relatively large, the second spring constant of the additional spring can be relatively small. Conversely, if the lever arm distance d is relatively small, the second spring constant of the additional spring is preferably relatively large.

Moreover, the first spring constant and/or the second spring constant can also be adapted in accordance with the site and/or range of application of the rotary pump. It can for example be expedient to select a smaller second spring constant of the additional spring if the rotary pump rapidly changes loads and/or there is a lot of vibration on the rotary pump, such that the additional spring is softer.

The restoring spring can also be fitted such that it has a first biasing force and/or the additional spring can be fitted such that it has a second biasing force. The first biasing force and the second biasing force can differ in magnitude. The first biasing force of the restoring spring can for example be greater than the second biasing force of the additional spring. Alternatively, the second biasing force of the additional spring can be greater than the first biasing force of the restoring spring.

The restoring spring and the additional spring can be identically formed in all their features, in particular shape, spring constant, spring characteristic and biasing force. Alternatively, the restoring spring and the additional spring can differ in one or more of their features. The restoring spring and the additional spring can for example both be helical compression springs having the same spring constant and the same spring characteristic, but be fitted such that they have different biasing forces.

The restoring force and the additional force can together generate a resultant external force. The external force resulting from the restoring force and the additional force can cross the rotational axis of the delivery member at a lever arm distance $d_E$. The line of action of the resultant external force preferably extends secantially with respect to the inner contour of the setting structure. The line of action of the resultant external force particularly preferably extends parallel to the setting direction.

The lever arm distance $d_E$ of the resultant external force is at most 30%, preferably at most 20%, of an inner width of the inner contour measured radially with respect to the rotational axis. The inner width is preferably measured orthogonally with respect to the setting direction. The inner width of the inner contour is preferably understood to mean the greatest extent of the inner contour transverse to the setting direction. If the inner contour is circular, the inner width corresponds to the diameter of the inner contour, i.e. if the inner contour is circular, the lever arm distance $d_E$ of the resultant external force is at most 30%, preferably at most 20%, of the diameter of the inner contour.

The resultant external force particularly preferably acts on a portion of the setting structure surrounding the high-pressure region of the delivery chamber. The resultant external force preferably acts counter to the setting direction. The resultant external force can act on the setting structure secantially with respect to the inner contour.

The resultant external force preferably generates a torque which acts on the setting structure. The torque generated by the resultant external force can be directed oppositely to the rotary direction of the delivery member, in particular when the pump is operating normally. Preferably, the torque generated by the resultant external force acts in the same direction as the torque generated by the additional force.

The torque generated by the resultant external force preferably compensates for the torque which is generated by the friction of the delivery member and which likewise acts completely or partially on the setting structure. The resultant external force can additionally compensate for a torque generated by the setting force and acting on the setting structure.

Since the torque generated by the friction of the delivery member depends inter alia on the rotational speed of the delivery member, the torque generated by the resultant external force is at least as large as the smallest torque generated by the delivery member.

In preferred embodiments, the setting structure has an abutment which comes into contact with a surface of the pump housing when the delivery volume of the rotary pump is at its maximum. The abutment thus preferably delineates the translational movement of the setting structure counter to the setting direction.

The line of action of the resultant external force preferably passes, in particular centrally, through the abutment of the setting structure. Alternatively, or additionally, the abutment is formed between the line of action of the restoring force and the line of action of the additional force. The abutment is preferably formed on the side of the setting structure radially opposite the restoring spring, in particular the side of the setting structure opposite the restoring spring and the additional spring.

Features of the invention are also described in the aspects formulated below. The aspects are formulated in the manner of claims and can substitute for them. Features disclosed in the aspects can also supplement and/or qualify the claims, indicate alternatives with respect to individual features and/or broaden claim features. Bracketed reference signs refer to example embodiments of the invention illustrated below in figures. They do not restrict the features described in the aspects to their literal sense as such, but do conversely indicate preferred ways of implementing the respective feature.

Aspect 1. A rotary pump having an adjustable delivery volume, comprising:

1.1 a pump housing (1) comprising a delivery chamber, a low-pressure region of which has a delivery chamber inlet (2) for a fluid to be delivered, and a high-pressure region of which has a delivery chamber outlet (3) for the fluid;

1.2 a delivery member which can be rotated about a rotational axis (R) in the delivery chamber in order to deliver the fluid;

1.3 a setting structure (10) which can be moved translationally back and forth in the pump housing (1) relative to the delivery member in and counter to a setting direction in order to adjust the delivery volume of the rotary pump, and which exhibits an inner contour (I) which delineates the delivery chamber radially on the outside;

1.4 a setting device (30, 31) for generating a setting force ($F_S$) which acts on the setting structure (10) in the setting direction;

1.5 a restoring spring (11) for exerting a restoring force ($F_R$) which acts on the setting structure (10) counter to the setting direction; and 1.6 an additional spring (12) for exerting an additional force ($F_A$) which acts on the setting structure (10) in or counter to the setting direction, 1.7 wherein the additional force ($F_A$) crosses the rotational axis (R) at a lever arm distance (d).

Aspect 2. The rotary pump according to the preceding aspect, wherein the additional force ($F_A$) and/or the restoring force ($F_R$) is exerted on the setting structure (10) secantially with respect to the inner contour (I).

Aspect 3. The rotary pump according to any one of the preceding aspects, wherein: the restoring force ($F_R$) and the additional force ($F_A$) generate a resultant external force ($F_E$); the resultant external force ($F_E$) crosses the rotational axis (R) at a lever arm distance ($d_E$); and the lever arm distance ($d_E$) is in particular at most 30%, preferably at most 20%, of an inner width (A) of the inner contour (I) as measured radially with respect to the rotational axis (R), wherein the inner width (A) is preferably measured orthogonally with respect to the setting direction.

Aspect 4. The rotary pump according to any one of the preceding aspects, wherein the additional force ($F_A$) acts counter to the setting direction on a portion of the setting structure (10) surrounding the high-pressure region of the delivery chamber, or wherein the additional force ($F_A$) acts in the setting direction on a portion of the setting structure (10) surrounding the low-pressure region of the delivery chamber.

Aspect 5. The rotary pump according to any one of the preceding aspects, wherein the additional force ($F_A$) generates a torque which acts on the setting structure (10) and is directed oppositely to the rotary direction of the delivery member.

Aspect 6. The rotary pump according to any one of the preceding aspects, wherein the restoring force ($F_R$) of the restoring spring (11) which acts on the setting structure (10) and/or the additional force ($F_A$) of the additional spring (12) which acts on the setting structure (10) act parallel to the setting direction or at an acute angle of less than 10° to the setting direction only.

Aspect 7. The rotary pump according to any one of the preceding aspects, wherein the restoring force ($F_R$) and the additional force ($F_A$) are introduced into the setting structure (10) at a spring force distance (D) from each other which is orthogonal with respect to the setting direction.

Aspect 8. The rotary pump according to the preceding aspect, wherein the spring force distance (D) is equal to or greater than the lever arm distance (d).

Aspect 9. The rotary pump according to any one of the preceding aspects, wherein the restoring force ($F_R$) acts on the setting structure (10) radially with respect to the rotational axis (R) or crosses the rotational axis (R) at a distance which is less than the lever arm distance (d) at which the additional force ($F_A$) crosses the rotational axis (R).

Aspect 10. The rotary pump according to any one of the preceding aspects, wherein the restoring force ($F_R$) is greater than the additional force ($F_A$).

Aspect 11. The rotary pump according to any one of the preceding aspects, wherein the restoring force ($F_R$) and the additional force ($F_A$) differ in magnitude in one or more different positions which the setting structure (10) can assume within the scope of its mobility in and counter to the setting direction, preferably in each position of the setting structure (10).

Aspect 12. The rotary pump according to any one of the preceding aspects, wherein the restoring force ($F_R$) and the additional force ($F_A$) generate a resultant external force ($F_E$) which acts on the setting structure (10) counter to the setting direction.

Aspect 13. The rotary pump according to the preceding aspect, wherein the setting structure (10) comprises an abutment (31) which comes into contact with a surface of the pump housing (1) when the delivery volume of the rotary pump is at its maximum, and wherein the line of action of the resultant external force ($F_E$) passes through the abutment (31).

Aspect 14. The rotary pump according to any one of the preceding two aspects, wherein the resultant external force ($F_E$) crosses the rotational axis (R) at a distance, and the resultant external force ($F_E$) acts counter to the setting direction on a portion of the setting structure (10) surrounding the high-pressure region of the delivery chamber.

Aspect 15. The rotary pump according to any one of the preceding three aspects, wherein the resultant external force ($F_E$) acts on the setting structure (10) secantially with respect to the inner contour (I).

Aspect 16. The rotary pump according to any one of the preceding four aspects, wherein the resultant external force ($F_E$) generates a torque which acts on the setting structure (10) and is directed oppositely to the rotary direction of the delivery member.

Aspect 17. The rotary pump according to any one of the preceding aspects, wherein the setting structure (10) comprises an abutment (31) which comes into contact with a surface of the pump housing (1) when the delivery volume of the rotary pump is at its maximum, and wherein the abutment (31) is formed between the line of action of the restoring force ($F_R$) and the line of action of the additional force ($F_A$).

Aspect 18. The rotary pump according to any one of the preceding four aspects, wherein the resultant external force ($F_E$) crosses the rotational axis (R) at a distance, and the distance is less than the lever arm distance (d).

Aspect 19. The rotary pump according to any one of the preceding aspects, wherein: the restoring spring (11) has a first spring constant and is fitted such that it has a first biasing force; and the additional spring (12) has a second spring constant and is fitted such that it has a second biasing force, wherein the first spring constant and the second spring constant are unequal and/or the first biasing force and the second biasing force are unequal.

Aspect 20. The rotary pump according to any one of the preceding aspects, wherein the setting structure (10) is linearly guided translationally in and counter to the setting direction.

Aspect 21. The rotary pump according to any one of the preceding aspects, wherein the restoring spring (11) and/or the additional spring (12) is a helical compression spring.

Aspect 22. The rotary pump according to any one of the preceding aspects, wherein the restoring spring (11) and/or the additional spring (12) is/are arranged in a restoring space (20) in the low-pressure region of the pump housing (1).

Aspect 23. The rotary pump according to any one of the preceding aspects, wherein the setting device (10) has one or more fluid setting chambers (30) and the respective fluid setting chamber (30) is permanently or selectively connected to the high-pressure region of the delivery chamber in order to permanently or selectively apply a fluid pressure to the setting structure (10) in the setting direction.

Aspect 24. The rotary pump according to any one of the preceding aspects, wherein the restoring force ($F_R$) and/or the additional force ($F_A$) is the only external force acting on the setting structure (10) which acts counter to the setting force ($F_S$).

Aspect 25. The rotary pump according to any one of the preceding aspects, wherein the inner contour (I) has an inner width (A) orthogonally with respect to the setting direction, wherein the inner width (A) is preferably measured radially with respect to the rotational axis (R), and the additional force ($F_A$) acts on the setting structure (10) from a bisector (B), which sub-divides the inner width (A) into two portions of equal length, at a lever arm distance (d) measured transversely with respect to the setting direction.

Aspect 26. The rotary pump according to any one of the preceding aspects, wherein the inner contour (I) has an inner width (A) orthogonally with respect to the setting direction, wherein the inner width (A) is preferably measured radially with respect to the rotational axis (R), and the restoring force ($F_R$) acts on the setting structure (10) from a bisector (B), which sub-divides the inner width (A) into two portions of equal length, at a distance ($d_R$) measured transversely with respect to the setting direction, or wherein the line of action of the restoring force ($F_R$) overlaps with the bisector (B) in an axial plan view onto the setting structure (10).

Aspect 27. The rotary pump according to any one of the preceding two aspects, wherein the bisector (B) divides the delivery chamber into the high-pressure region and the low-pressure region.

BRIEF DESCRIPTION OF THE DRAWINGS

The invention is described below on the basis of example embodiments. Features disclosed by the example embodiments advantageously develop the subject-matter of the claims and also the embodiments described above. There is shown:

DETAILED DESCRIPTION OF THE PREFERRED EMBODIMENTS

Figure 1:
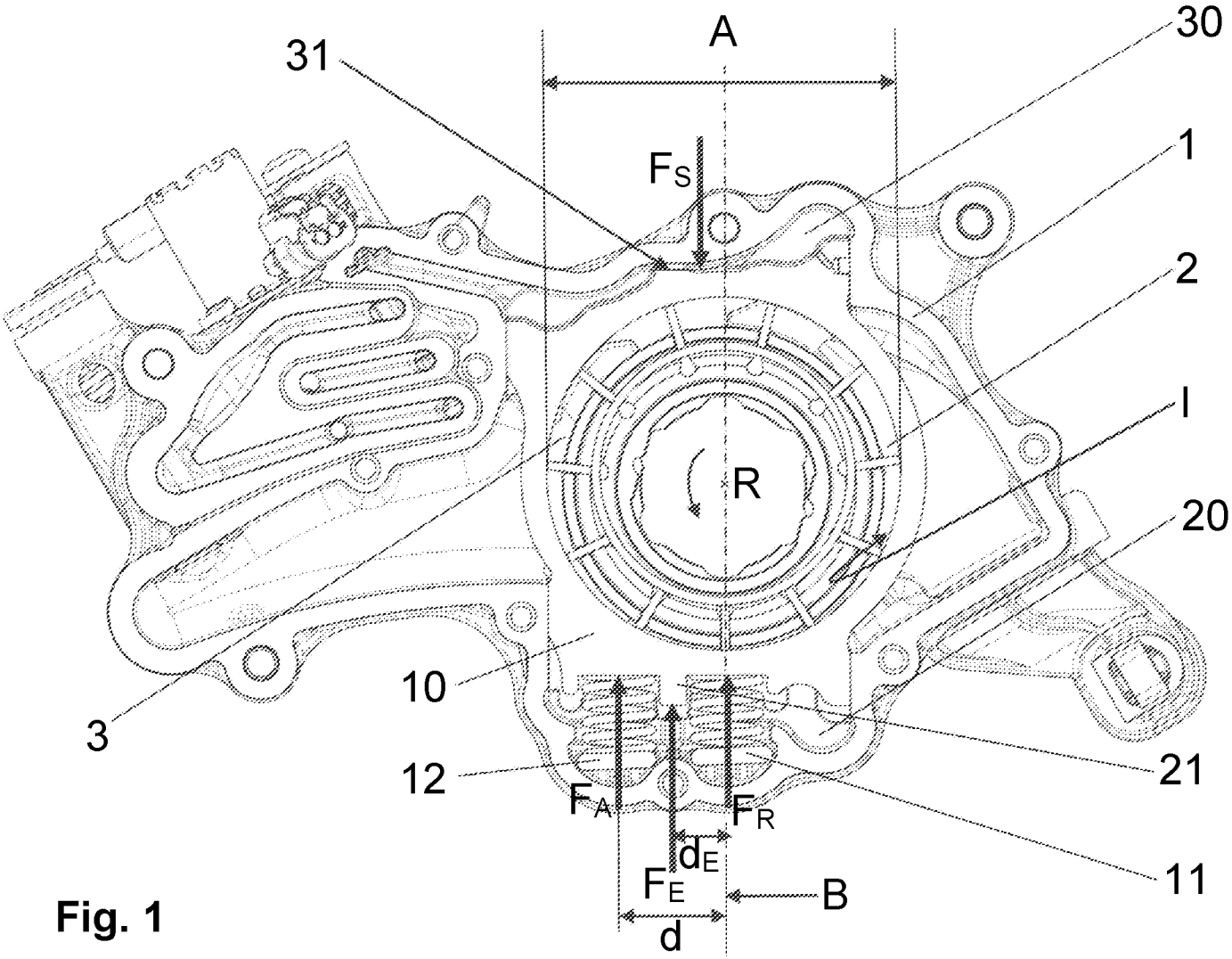
FIG. 1 a cross-section of a rotary pump having an adjustable delivery volume in a first example embodiment.
Figure 4:
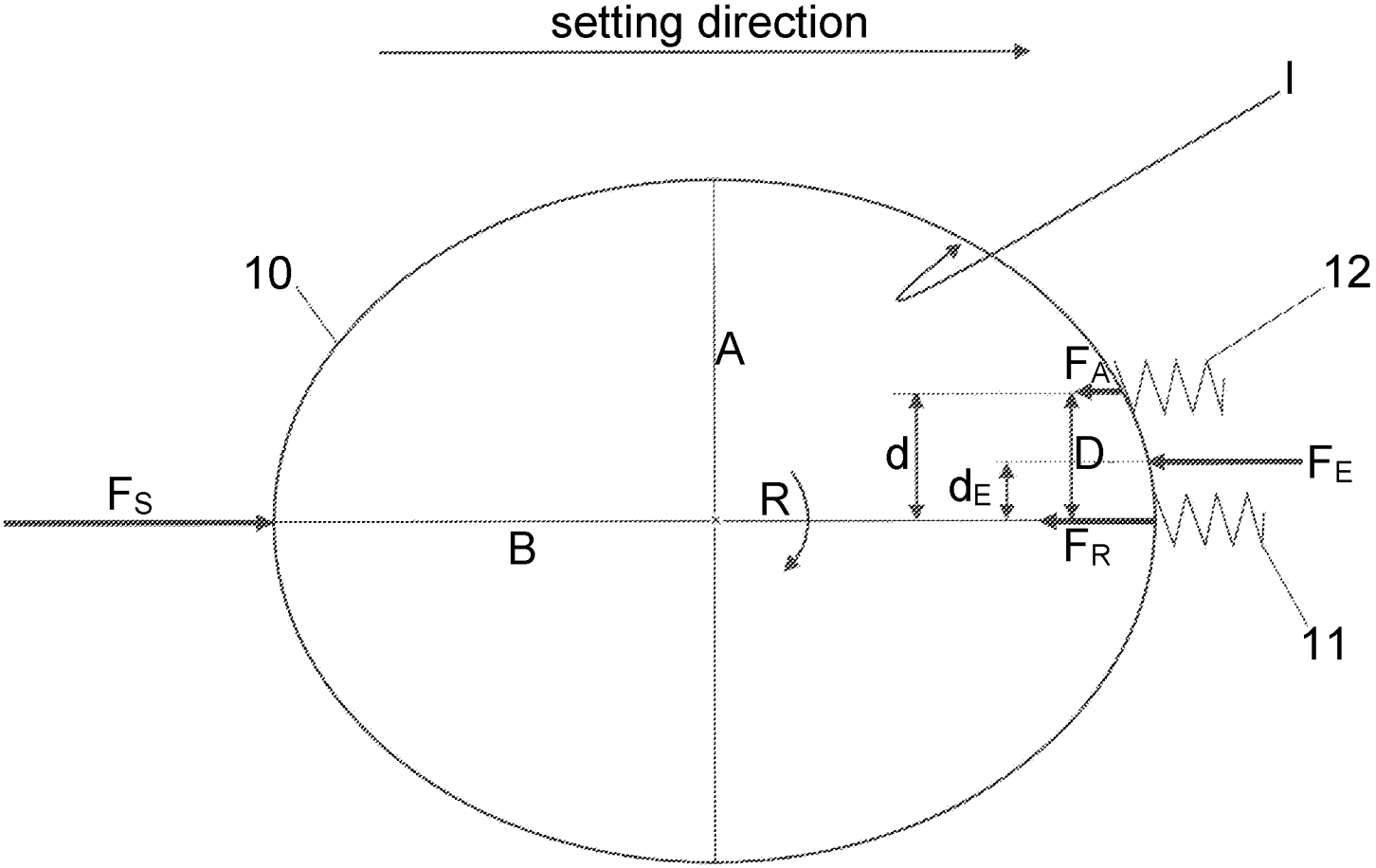
FIG. 4 a schematic drawing of the rotary pump of the first example embodiment.

FIG. 1 and FIG. 4 show a rotary pump having an adjustable delivery volume in accordance with a first example embodiment. The rotary pump includes a pump housing 1 comprising a delivery chamber, a low-pressure region of which has a delivery chamber inlet 2 for a fluid to be delivered, and a high-pressure region of which has a delivery chamber outlet 3 for the fluid. A delivery member which can be rotated about a rotational axis R in order to deliver the fluid is arranged in the delivery chamber. The delivery member is formed by a delivery rotor and multiple vanes mounted in the delivery rotor such that they can slide.

For adjusting the delivery volume of the rotary pump, the pump housing 1 of the rotary pump includes a setting structure 10 which can be translationally moved back and forth relative to the delivery member in and counter to a setting direction and which has an inner contour I which delineates the delivery chamber radially on the outside. The setting structure 10 is formed by a setting ring which encloses the delivery chamber radially on the outside, and the inner contour I of which is formed to be circular. The setting structure 10 does not delineate the delivery chamber in the axial direction.

A setting device 30, 31 for generating a setting force $F_S$ which acts on the setting structure 10 in the setting direction is formed in the pump housing 1. The setting device 30, 31 is formed by a fluid setting chamber 30 and an abutment 31. The fluid setting chamber 30 is preferably connected permanently or selectively to the high-pressure region of the delivery chamber, such that the fluid can act on a setting surface of the setting structure 10. The fluid can be diverted from the delivery chamber outlet 3 of the delivery chamber and fed to the fluid setting chamber 30 directly or for example via a control valve.

The setting force $F_S$ acts on the setting structure 10 in the setting direction. Moving the setting structure 10 in the setting direction throttles the pump, i.e. reduces the delivery volume. Accordingly, moving the setting structure 10 counter to the setting direction increases the delivery volume, wherein the setting force $F_S$ results from the fluid acting on the setting structure 10 and located in the fluid setting chamber 30, and is indicated as a resultant force in FIG. 1.

As can be seen from FIG. 1, the resultant setting force $F_S$ crosses the rotational axis R of the rotary pump at a distance. This generates a torque which acts on the setting structure 10 in the rotational direction. In addition to the torque generated by the setting force $F_S$, a frictional moment which corresponds to a torque acting in the rotational direction of the delivery member additionally acts on the setting structure 10 when the delivery member is rotated. Alternatively, the resultant setting force $F_S$ can act on the setting structure 10 radially in relation to the inner contour I, as indicated in the schematic drawing in FIG. 4. In this case, the resultant setting force $F_S$ does not generate a torque which acts on the setting structure 10.

The rotary pump also includes a restoring spring 11 for exerting a restoring force $F_R$, which acts on the setting structure 10 counter to the setting direction, and an additional spring 12 for exerting an additional force $F_A$ which likewise acts on the setting structure 10 counter to the setting direction. The restoring spring 11 and the additional spring 12 act on the setting structure 10 on a side of the setting structure 10 radially opposite the fluid setting chamber 30 in the setting direction.

The restoring spring 11 is arranged in a restoring space 20. In accordance with the example embodiment of FIG. 1, the restoring space 20 is formed radially opposite the fluid setting chamber 30 in the setting direction. The fluid setting chamber 30 and the restoring space 20 are fluidically separated from each other, i.e. fluid from the fluid setting chamber 30 cannot flow into the restoring space 20 and vice versa. The restoring space 20 is preferably free of pressure. The restoring space 20 is preferably connected to the low-pressure region of the rotary pump. In addition to the restoring spring 11, the additional spring 12 is also arranged in the restoring space 20.

The restoring spring 11 and the additional spring 12 are each formed by a helical compression spring. In accordance with the present example embodiment, the restoring spring 11 and the additional spring 12 are cylindrical helical compression springs. The person skilled in the art will be aware that this is merely an example embodiment and that the restoring spring 11 and the additional spring 12 can also be formed by other types of spring, for example disc springs, hollow rubber springs or the like.

The restoring spring 11 has a first spring constant, and the additional spring 12 has a second spring constant. The first spring constant of the restoring spring 11 and the second spring constant of the additional spring 12 preferably differ in magnitude. In the present example embodiment, the second spring constant of the additional spring 12 is preferably less than the first spring constant of the restoring spring 11. Here, too, it will be self-evident to the person skilled in the art to appropriately adapt the first spring constant and/or the second spring constant.

The restoring spring 11 exerts a restoring force $F_R$ acting counter to the setting direction on the setting structure 10. In accordance with the first example embodiment, the restoring force $F_R$ acts on the setting structure 10 radially in relation to the inner contour I of the setting structure 10, i.e. the restoring force $F_R$ crosses the rotational axis R at a distance which is equal to zero.

The additional spring 12 exerts the additional force $F_A$ acting counter to the setting direction on the setting structure 10. In accordance with the first example embodiment of FIG. 1 and FIG. 4, the additional force $F_A$ crosses the rotational axis R at a lever arm distance d; in particular, the additional force $F_A$ acts secantially on the setting structure 10, wherein the additional force $F_A$ acts on a portion of the setting structure 10 surrounding the high-pressure region of the delivery chamber.

As can be seen in FIG. 4 in particular, the inner contour I of the setting structure 10 has an inner width A, which is divided by the bisector B transversely with respect to the setting direction into two portions of equal length. The additional force $F_A$ is spaced from the bisector B by the lever arm distance d. In accordance with the first example embodiment, the line of action of the restoring spring 11 overlaps with the bisector B.

Due to the lever arm distance d, the additional force $F_A$ generates a torque which acts on the setting structure 10 counter to the rotational direction of the delivery member. The torque generated by the additional force $F_A$ preferably at least partially compensates for the torques which are generated by the setting force $F_S$ and the frictional moment and which act on the setting structure 10 in the rotational direction.

The restoring force $F_R$ and the additional force $F_A$ are introduced into the setting structure 10 at a spring force distance D from each other which is orthogonal with respect to the setting direction. In accordance with the example embodiment of FIG. 1 and FIG. 4, respectively, the spring force distance D is the same as the lever arm distance d at which the additional force $F_A$ crosses the rotational axis R. The additional force $F_A$ acts on a portion of the setting structure 10 surrounding the high-pressure region of the delivery chamber.

The restoring force $F_R$ and/or the additional force $F_A$ then act on the setting structure 10 parallel to the setting direction only, i.e. the restoring force $F_R$ corresponds to the resultant spring force exerted by the restoring spring 11 and/or the additional force $F_A$ corresponds to the resultant spring force exerted by the additional spring 12.

The restoring force $F_R$ and the additional force $F_A$ together generate a resultant external force $F_E$ which crosses the rotational axis R at a lever arm distance $d_E$. The lever arm distance $d_E$ of the resultant external force $F_E$ is at most 30%, preferably at most 20%, of the inner width A of the inner contour I as measured radially with respect to the rotational axis R. The resultant external force $F_E$ acts on a portion of the setting structure 10 surrounding the high-pressure region of the delivery chamber. The resultant external force $F_E$ thus generates a torque which acts on the setting structure 10 counter to the rotational direction of the rotary pump when the pump is operating normally.

In the region of the fluid setting chamber 30, the setting structure 10 has an abutment 31 which comes into contact with a surface of the pump housing 1 when the delivery volume of the rotary pump is at its maximum. The abutment 31 thus limits the translational movement of the setting structure 10 counter to the setting direction.

The line of action of the resultant external force $F_E$ passes, in particular centrally, through the abutment 31 of the setting structure 10. The abutment 31 is also formed between the line of action of the restoring force $F_R$ and the line of action of the additional force $F_A$. The setting force $F_S$ preferably does not act on the abutment 31, i.e. the line of action of the setting force $F_S$ does not pass through the abutment 31.

In addition to the abutment 31, the setting structure 10 has a protrusion 21 which is formed on the side of the setting structure 10 axially opposite the abutment 31. The protrusion 21 lies opposite the abutment 31 in the setting direction, preferably exactly opposite the abutment 31. The protrusion 21 is formed centrally between the restoring spring 11 and the additional spring 12, i.e. the protrusion 21 is formed centrally between the line of action of the restoring force $F_R$ and the line of action of the additional force $F_A$. The line of action of the resultant external force $F_E$ also passes through the protrusion 21.

The protrusion 21 serves to mount the restoring spring 11 and the additional spring 12, such that the end of the restoring spring 11 which rests against the setting structure 10 and/or the end of the additional spring 12 which rests against the setting structure 10 is/are restricted in its/their movement transverse to the setting direction. The protrusion 21 also serves to separate the two spring ends transversely with respect to the setting direction.

Figure 2:
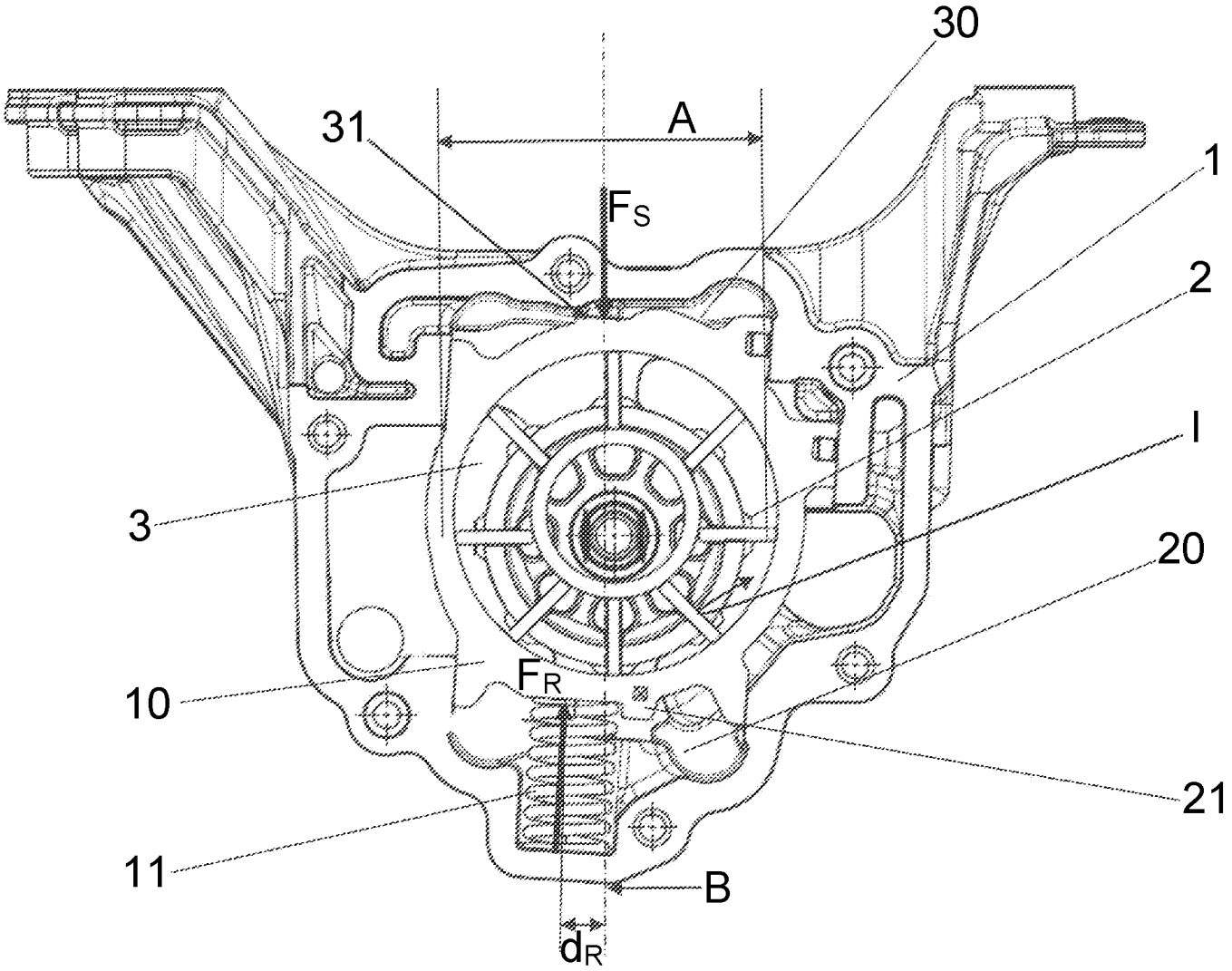
FIG. 2 a cross-section of a rotary pump having an adjustable delivery volume in a second example embodiment.
Figure 3:
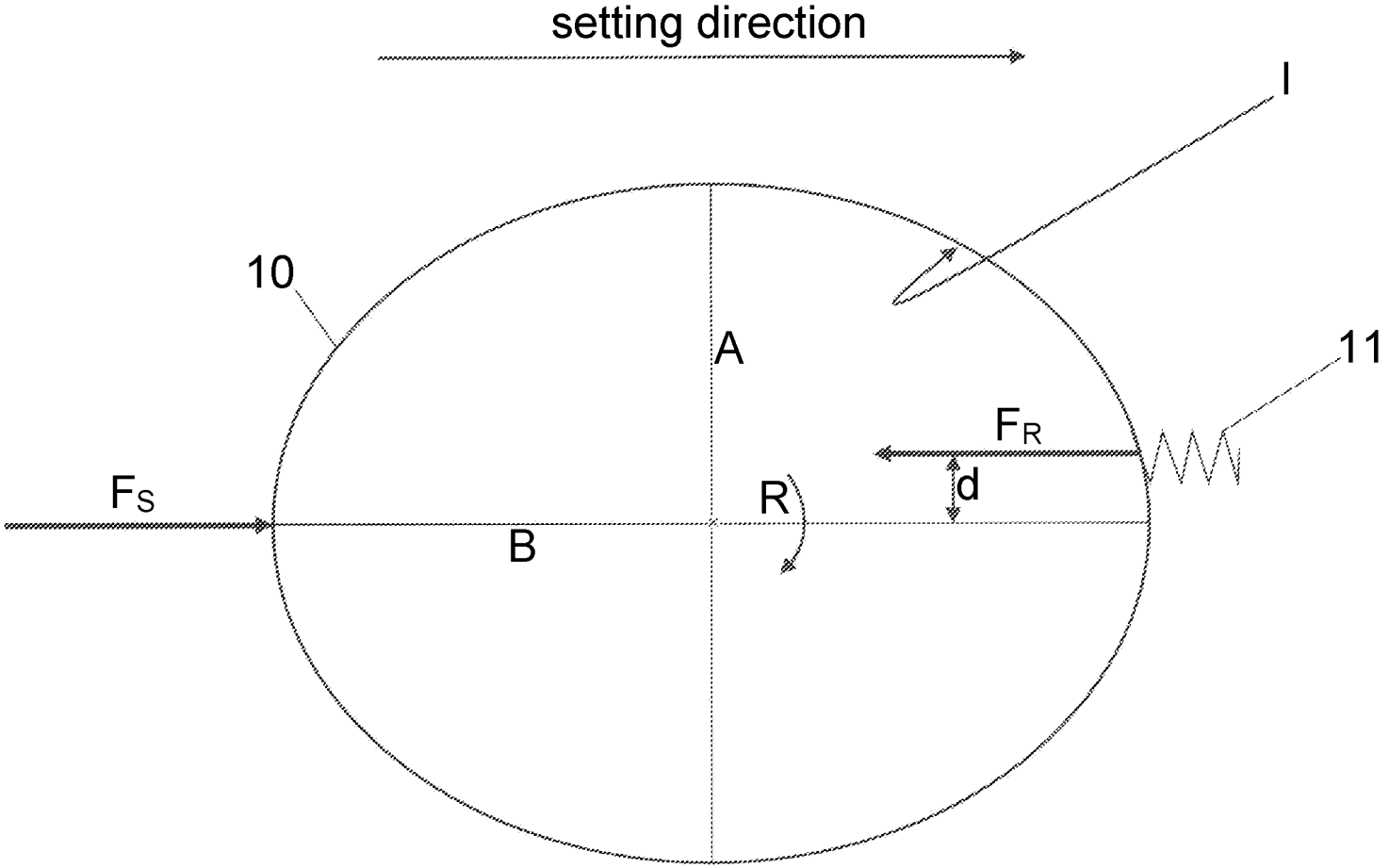
FIG. 3 a schematic drawing of the rotary pump of the second example embodiment.

FIG. 2 shows a cross-section of a rotary pump having an adjustable delivery volume in a second example embodiment. FIG. 3 shows a schematic drawing of the rotary pump of the second example embodiment. The rotary pump in accordance with the second example embodiment differs only immaterially from the example embodiment in accordance with FIG. 1. In the following, therefore, only the differences between the first example embodiment and the second example embodiment shall be discussed. Statements relating to the first example embodiment also apply to the example embodiment in accordance with FIG. 2, providing they do not contradict the second example embodiment.

The rotary pump in accordance with FIG. 2 differs from the example embodiment of FIG. 1 in particular in that the rotary pump comprises only a restoring spring 11 for exerting a restoring force $F_R$ which acts on the setting structure 10 counter to the setting direction, i.e. unlike the rotary pump of the first example embodiment, the rotary pump in accordance with FIG. 2 does not include an additional spring 12.

The restoring spring 11 generates a restoring force $F_R$ which crosses the rotational axis R at a distance $d_R$, wherein the restoring force $F_R$ acts on the setting structure 10 secantially with respect to the inner contour I, i.e. the line of action of the restoring force $F_R$ is a secant in relation to the inner contour I of the setting structure 10, i.e. contrary to the first example embodiment, the restoring force $F_R$ does not act on the setting structure 10 radially in relation to the inner contour I of the setting structure 10.

The distance $d_R$ is at most 30%, preferably 20%, of the inner width A of the inner contour I as measured radially with respect to the rotational axis R, wherein the inner width A is measured orthogonally with respect to the setting direction. The restoring spring 11 in accordance with the second example embodiment thus performs the function of the additional spring 12 and at the same time the function of the restoring spring 11 of the first example embodiment. In other words, the restoring force $F_R$ corresponds to the resultant external force $F_E$ of the first example embodiment, i.e. what has been said regarding the resultant external force $F_E$ applies equally to the restoring force $F_R$ of the second example embodiment.

The restoring force $F_R$ preferably acts on the portion of the setting structure 10 surrounding the high-pressure region of the delivery chamber. The restoring force $F_R$ thus generates a torque which acts on the setting structure 10 counter to the rotational direction of the rotary pump when the pump is operating normally.

The rotary pump in accordance with the second example embodiment likewise has an abutment 31 which comes into contact with a surface of the pump housing 1 when the delivery volume of the rotary pump is at its maximum. The abutment 31 thus limits the translational movement of the setting structure 10 counter to the setting direction.

Contrary to the line of action of the resultant external force $F_E$ in accordance with the first example embodiment, however, the line of action of the restoring force $F_R$ does not pass through the abutment 31 of the setting structure 10. The setting force $F_S$ in accordance with FIG. 2 likewise acts on the setting structure 10 radially in relation to the inner contour I of the setting structure 10, i.e. the setting force $F_S$ crosses the rotational axis R at a lever arm distance which is equal to zero.

The example embodiment of FIG. 2 otherwise corresponds to the example embodiment of FIG. 1.

Figure 5:
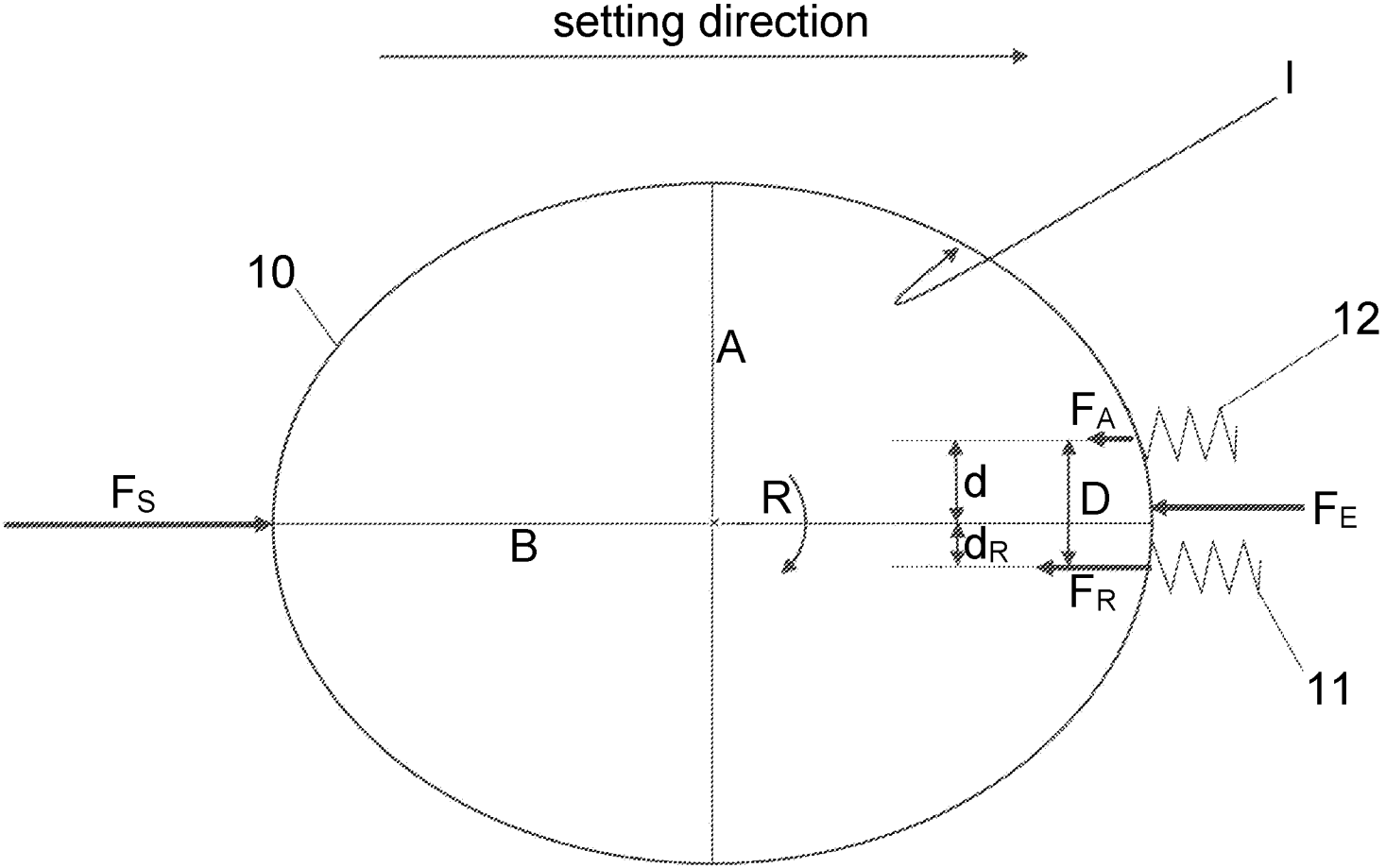
FIG. 5 a schematic drawing of a rotary pump in a third example embodiment.

FIG. 5 shows a schematic drawing of a rotary pump in a third example embodiment. Since the third example embodiment differs only immaterially from the first example embodiment, only the differences will substantially be discussed. Statements made with respect to the first example embodiment also apply to the third example embodiment, providing they do not contradict the third example embodiment.

The rotary pump in accordance with the third example embodiment substantially corresponds to the first example embodiment, i.e. in accordance with the third example embodiment, the rotary pump has a restoring spring 11 and an additional spring 12, wherein the restoring spring 11 generates a restoring force $F_R$ which acts on the setting structure 10 counter to the setting direction, and the additional spring 12 generates an additional force $F_A$ which together with the restoring force $F_R$ acts on the setting structure 10 counter to the setting direction.

The example embodiment in accordance with FIG. 5 differs from the example embodiment in accordance with FIG. 1 and FIG. 4 in that the restoring force $F_R$ does not act on the setting structure 10 radially in relation to the inner contour I. Contrary to the first example embodiment, the restoring force $F_R$ acts secantially. The restoring force $F_R$ crosses the rotational axis R at a distance $d_R$.

The distance $d_R$ at which the restoring force $F_R$ crosses the rotational axis R is less than the lever arm distance d at which the additional force $F_A$ crosses the rotational axis R. The restoring force $F_R$ and the additional force $F_A$ are introduced into the setting structure 10 at a spring force distance D, wherein the spring force distance D results from the sum of the lever arm distance d and the distance $d_R$. The restoring force $F_R$ and the additional force $F_A$ act on the setting structure 10 orthogonally with respect to the setting direction and on different sides of the bisector B.

In accordance with the example embodiment of FIG. 5, the restoring force $F_R$ preferably acts on a portion of the setting structure 10 surrounding the low-pressure region of the delivery chamber, i.e. the restoring force $F_R$ generates a torque which acts on the setting structure 10 in the rotational direction of the delivery member. Like the additional force $F_A$ of the first example embodiment, the additional force $F_A$ of the third example embodiment generates a torque which acts on the setting structure 10 counter to the rotational direction. The torque which this additional force $F_A$ generates is greater than the torque which the restoring force $F_R$ generates, such that as a result, the restoring force $F_R$ and the additional force $F_A$ generate a resultant torque which acts on the setting structure 10 counter to the rotational direction of the delivery member.

In other words, the restoring force $F_R$ and the additional force $F_A$ generate a resultant external force $F_E$ which acts secantially on the setting structure 10. The lever arm distance d at which the additional force $F_A$ crosses the rotational axis R and the distance $d_R$ at which the restoring force $F_R$ crosses the rotational axis R, as well as the additional force $F_A$ and the restoring force $F_R$, are set such that the resultant external Force $F_E$ preferably acts on a portion of the setting structure 10 surrounding the high-pressure region of the delivery chamber, i.e. the resultant external force $F_E$ generates a torque which acts on the setting structure 10 counter to the rotational direction of the delivery member.

Figure 6:
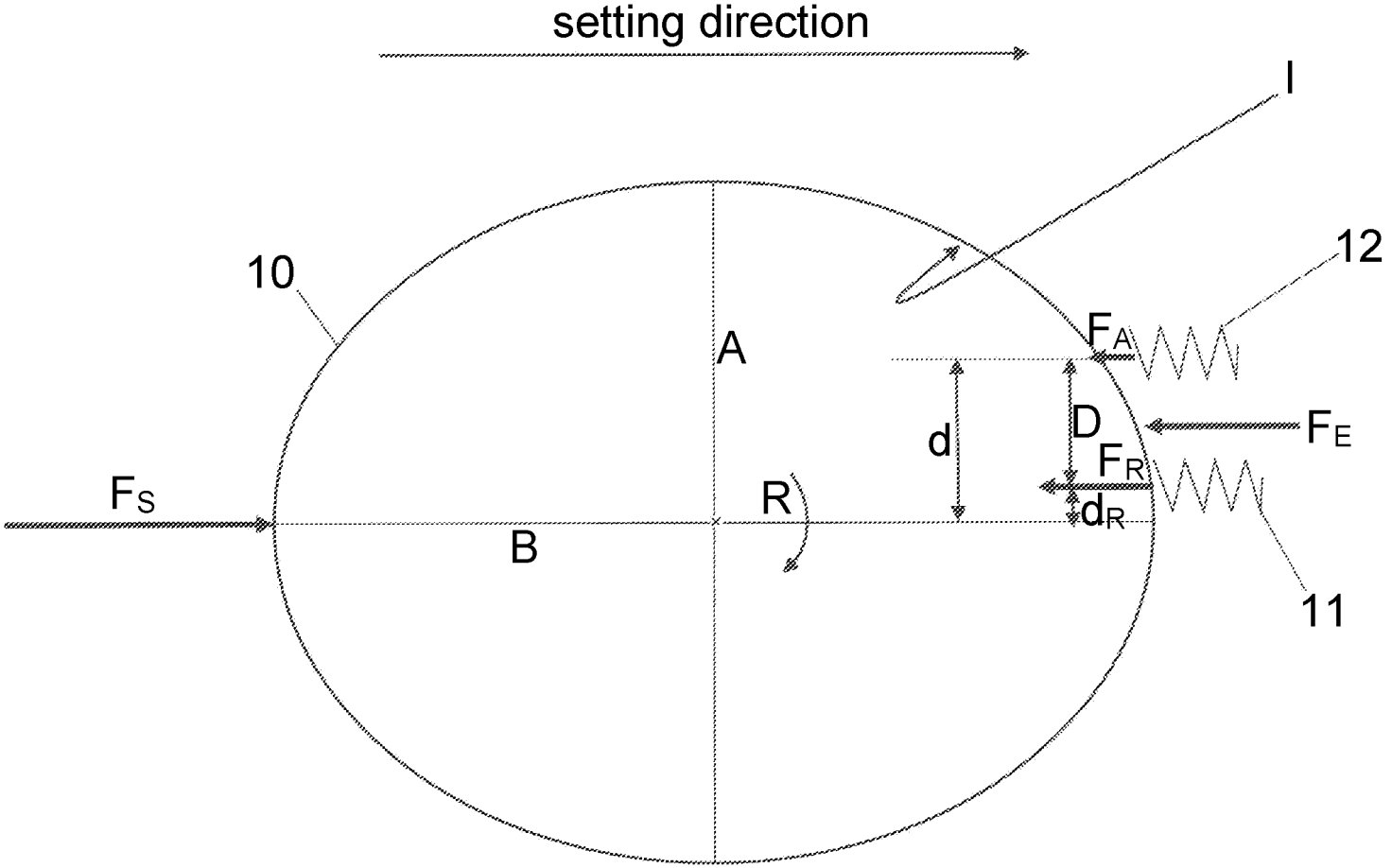
FIG. 6 a schematic drawing of a rotary pump in accordance with a fourth example embodiment.

FIG. 6 shows a schematic drawing of a fourth example embodiment. Since the fourth example embodiment differs only immaterially from the first and third example embodiments, only the differences shall substantially be discussed. Statements made with respect to the first and third example embodiments also apply to the fourth example embodiment, providing they do not contradict it.

In accordance with the fourth example embodiment, the restoring force $F_R$ likewise crosses the rotational axis R at a distance $d_R$, but the restoring force $F_R$ together with the additional force $F_A$ preferably acts on a portion of the setting structure 10 surrounding the high-pressure region of the delivery chamber. The restoring force $F_R$ and the additional force $F_A$ act on the setting structure 10 orthogonally with respect to the setting direction and on the same side of the bisector B.

The distance $d_R$ at which the restoring force $F_R$ crosses the rotational axis R, plus the spring force distance D, equals the lever arm distance d at which the additional force $F_A$ crosses the rotational axis R.

Figure 7:
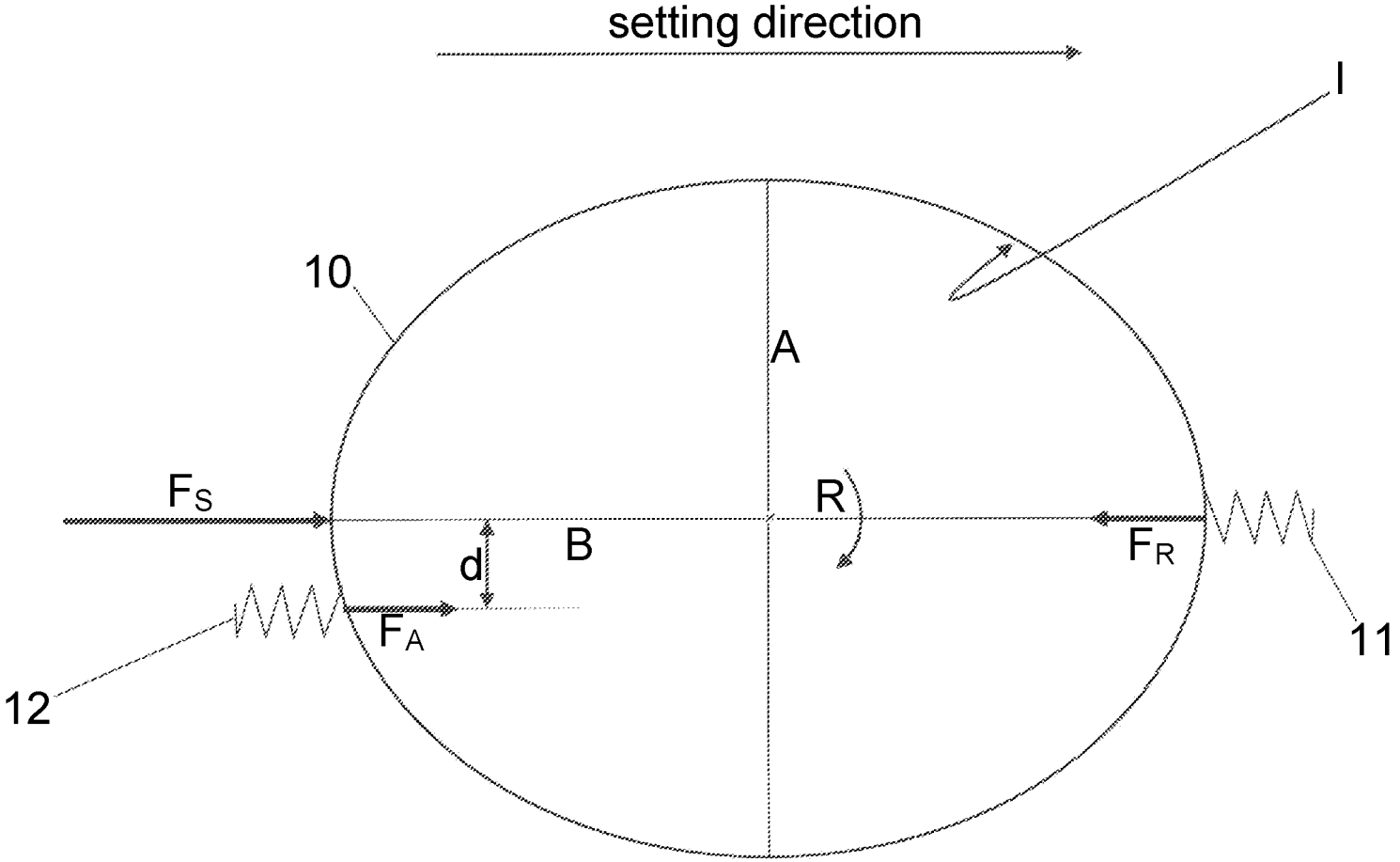
FIG. 7 a schematic drawing of a rotary pump in accordance with a fifth example embodiment.

FIG. 7 shows a schematic drawing of a fifth example embodiment. Since the fifth example embodiment differs from the first example embodiment only with regard to the additional spring 12 and the additional force $F_A$, only the differences shall substantially be discussed. Statements made with respect to the first example embodiment also apply to the fifth example embodiment, providing they do not contradict it.

Contrary to the example embodiment in accordance with FIG. 1, the additional spring 12 is arranged on the side of the setting structure 10 radially opposite the restoring spring 11. The additional spring 12 generates an additional force $F_A$ which acts on the setting structure 10 in the setting direction, i.e. contrary to the other example embodiments, the additional force $F_A$ acts in the same direction as the setting force $F_S$.

The overall setting force $F_S$ is composed, so to speak, of multiple force components, wherein one force component is formed by the setting force $F_S$ and a second force component is formed by the additional force $F_A$, wherein both force components act permanently on the setting structure 10.

The additional force $F_A$ crosses the rotational axis R at a lever arm distance d, wherein the additional force $F_A$ preferably acts on a portion of the setting structure 10 surrounding the low-pressure region of the delivery chamber. In this way, the additional force $F_A$ generates a torque which acts on the setting structure 10 in the opposite direction to the torque of the delivery member generated by friction and counter to the rotational direction.

The setting force $F_S$ of the setting device 30, 31 and the additional force $F_A$ of the additional spring 12 preferably act on the setting structure 10 parallel to the setting direction or at an acute angle of less than 10° to the setting direction.

REFERENCE SIGNS

1 pump housing
2 delivery chamber inlet
3 delivery chamber outlet
10 setting structure
11 restoring spring
12 additional spring
20 restoring space
21 protrusion
30 fluid setting chamber
31 abutment
A inner width
B bisector
D spring force distance
d lever arm distance of the additional force
$d_E$ lever arm distance of the resultant external force
$d_R$ distance of the restoring force
$F_E$ resultant external force
$F_S$ setting force
$F_R$ restoring force
$F_A$ additional force
I inner contour
R rotational axis

The invention claimed is:

1. A rotary pump having an adjustable delivery volume, comprising:

1.1. a pump housing comprising a delivery chamber, a low-pressure region of which has a delivery chamber inlet for a fluid to be delivered, and a high-pressure region of which has a delivery chamber outlet for the fluid;

1.2. a delivery member which can be rotated about a rotational axis in the delivery chamber in order to deliver the fluid;

1.3. a setting structure which can be moved translationally back and forth in the pump housing relative to the delivery member in and counter to a setting direction in order to adjust the delivery volume of the rotary pump, and which exhibits an inner contour which delineates the delivery chamber radially on the outside;

1.4. a setting device for generating a setting force which acts on the setting structure in the setting direction;

1.5. a restoring spring for exerting a restoring force which acts on the setting structure counter to the setting direction; and 1.6. an additional spring for exerting an additional force which acts on the setting structure counter to the setting direction, 1.7 wherein the additional force crosses the rotational axis at a lever arm distance, 1.8 wherein the setting structure is linearly guided translationally in and counter to the setting direction, and 1.9 wherein the restoring force and the additional force generate a resultant external force, the resultant external force crosses the rotational axis at a lever arm distance.

2. The rotary pump according to claim 1, wherein the additional force and/or the restoring force act(s) on the setting structure secantially with respect to the inner contour.

3. The rotary pump according to claim 1, wherein the additional force acts counter to the setting direction on a portion of the setting structure surrounding the high-pressure region of the delivery chamber.

4. The rotary pump according to claim 1, wherein the additional force generates a torque which acts on the setting structure and is directed oppositely to the rotary direction of the delivery member.

5. The rotary pump according to claim 1, wherein the restoring force and the additional force generate a resultant external force, and the external force generates a torque which acts on the setting structure and is directed oppositely to the rotary direction of the delivery member.

6. The rotary pump according to claim 1, wherein the restoring force of the restoring spring which acts on the setting structure and/or the additional force of the additional spring which acts on the setting structure act parallel to the setting direction or at an acute angle of less than 10° to the setting direction only.

7. The rotary pump according to claim 1, wherein the restoring force and the additional force act on the setting structure at a spring force distance from each other which is orthogonal with respect to the setting direction.

8. The rotary pump according to claim 7, wherein the spring force distance is equal to or greater than the lever arm distance.

9. The rotary pump according to claim 1, wherein the restoring force acts on the setting structure radially with respect to the rotational axis or crosses the rotational axis at a distance which is less than the lever arm distance at which the additional force crosses the rotational axis.

10. The rotary pump according to claim 1, wherein the restoring force is greater than the additional force.

11. The rotary pump according to claim 1, wherein the restoring force and the additional force differ in magnitude in one or more different positions which the setting structure can assume within the scope of its mobility in and counter to the setting direction.

12. The rotary pump according to claim 11, wherein the restoring force and the additional force differ in magnitude in each position of the setting structure.

13. The rotary pump according to claim 1, wherein the restoring force and the additional force generate a resultant external force which acts on the setting structure counter to the setting direction.

14. The rotary pump according to claim 13, wherein the setting structure comprises an abutment which comes into contact with a surface of the pump housing when the delivery volume of the rotary pump is at its maximum, and wherein the line of action of the resultant external force passes through the abutment.

15. The rotary pump according to claim 13, wherein the resultant external force crosses the rotational axis at a distance and perpendicular to the rotational axis, and the resultant external force acts counter to the setting direction on a portion of the setting structure surrounding the high-pressure region of the delivery chamber.

16. The rotary pump according to claim 13, wherein the resultant external force acts on the setting structure secantially with respect to the inner contour, and the resultant external force generates a torque which acts on the setting structure and is directed oppositely to the rotary direction of the delivery member when the pump is operating normally.

17. The rotary pump according to claim 1, wherein the additional force crosses the rotational axis at a lever arm distance. wherein the setting structure comprises an abutment which comes into contact with a surface of the pump housing when the delivery volume of the rotary pump is at its maximum, and wherein the abutment is formed between the line of action of the restoring force and the line of action of the additional force.

18. The rotary pump according to claim 1, wherein the lever arm distance is at most 20% of an inner width of the inner contour as measured radially with respect to the rotational axis.

19. The rotary pump according to claim 18, wherein the inner width is orientated orthogonally with respect to the setting direction.

20. The rotary pump according to claim 1, wherein the lever arm distance is at most 30% of an inner width of the inner contour as measured radially with respect to the rotational axis.

21. A rotary pump having an adjustable delivery volume, comprising:

a pump housing comprising a delivery chamber, a low-pressure region of which has a delivery chamber inlet for a fluid to be delivered, and a high-pressure region of which has a delivery chamber outlet for the fluid;

a delivery member which can be rotated about a rotational axis in the delivery chamber in order to deliver the fluid;

a setting structure which can be moved translationally back and forth in the pump housing relative to the delivery member in and counter to a setting direction in order to adjust the delivery volume of the rotary pump, and which exhibits an inner contour which delineates the delivery chamber radially on the outside;

a setting device for generating a setting force which acts on the setting structure in the setting direction;

a restoring spring for exerting a restoring force which acts on the setting structure counter to the setting direction; and an additional spring for exerting an additional force which acts on the setting structure counter to the setting direction, wherein the additional force crosses the rotational axis at a lever arm distance, wherein the setting structure is linearly guided translationally in and counter to the setting direction, wherein the restoring force and the additional force generate a resultant external force; the resultant external force crosses the rotational axis at a lever arm distance, and wherein the lever arm distance is at most 30% of an inner width of the inner contour as measured radially with respect to the rotational axis.

* * * * *